US010709930B2

(12) United States Patent
Fleming

(10) Patent No.: US 10,709,930 B2
(45) Date of Patent: Jul. 14, 2020

(54) HIP THRUST EXERCISE DEVICE

(71) Applicant: Edward Paul Fleming, Punta Gorda, FL (US)

(72) Inventor: Edward Paul Fleming, Punta Gorda, FL (US)

( * ) Notice: Subject to any disclaimer, the term of this patent is extended or adjusted under 35 U.S.C. 154(b) by 110 days.

(21) Appl. No.: 16/164,945

(22) Filed: Oct. 19, 2018

(65) Prior Publication Data

US 2020/0121983 A1 Apr. 23, 2020

(51) Int. Cl.

| | |
|---|---|
| ***A63B 23/02*** | (2006.01) |
| ***A63B 21/008*** | (2006.01) |
| ***A63B 23/04*** | (2006.01) |
| ***A63B 21/04*** | (2006.01) |
| ***A63B 21/00*** | (2006.01) |

(52) U.S. Cl.

CPC ..... *A63B 23/0211* (2013.01); *A63B 21/008* (2013.01); *A63B 21/0428* (2013.01); *A63B 21/159* (2013.01); *A63B 21/4033* (2015.10); *A63B 21/4045* (2015.10); *A63B 23/0405* (2013.01)

(58) Field of Classification Search

CPC ..... A23B 23/0211; A23B 23/214033; A23B 23/4045; A23B 23/008; A23B 23/0428; A23B 23/159

See application file for complete search history.

(56) References Cited

U.S. PATENT DOCUMENTS

| | | | | |
|---|---|---|---|---|
| 4,304,402 | A * | 12/1981 | Ripp | A63B 21/055 403/307 |
| 5,897,470 | A | 4/1999 | Chen | |
| 5,954,622 | A | 9/1999 | Olschansky et al. | |
| 6,468,188 | B1 | 10/2002 | Koenig | |
| 6,533,710 | B2 * | 3/2003 | Lin | A63B 21/055 482/121 |
| 7,361,125 | B2 * | 4/2008 | Webber | A63B 23/03525 482/130 |
| 8,002,683 | B1 | 8/2011 | Nayebdadash | |
| 8,523,745 | B1 * | 9/2013 | Ihli | A63B 21/00185 482/114 |
| 9,919,179 | B2 * | 3/2018 | Nevarez, Jr. | A63B 21/0552 |
| 2004/0053757 | A1 * | 3/2004 | Chung | A63B 23/03525 482/140 |
| 2007/0287619 | A1 * | 12/2007 | Tuller | A63B 21/055 482/140 |
| 2010/0016131 | A1 | 1/2010 | Hoffman | |
| 2013/0045844 | A1 * | 2/2013 | Huang | A63B 21/0004 482/140 |
| 2017/0239518 | A1 * | 8/2017 | Porteros De Luz | A63B 21/159 |
| 2017/0304677 | A1 * | 10/2017 | Clinton | A63B 21/00185 |
| 2018/0008857 | A1 * | 1/2018 | Barber | A63B 21/4009 |
| 2019/0299045 | A1 * | 10/2019 | Saffaie | A63B 21/4011 |
| 2020/0086171 | A1 * | 3/2020 | Meredith | A63B 23/0482 |

* cited by examiner

*Primary Examiner* — Joshua T Kennedy
(74) *Attorney, Agent, or Firm* — George F. Wallace

(57) ABSTRACT

A hip thrust exercise device includes a main body; a foot mount connected to the first body portion; a grip connected to the second body portion; an extension hingedly connected to the main and an abutment element; and a resistance element connected between the extension and main body. The resistance element provides a resistance force when the abutment element is moved away from the first body portion.

17 Claims, 4 Drawing Sheets

HIP THRUST EXERCISE DEVICE

FIELD OF THE INVENTION

The present invention relates to an exercise device, and more specifically, to a hip thrust exercise device.

SUMMARY OF THE INVENTION

It is an object of the present invention to provide a hip thrust exercise device and method of use.

It is another object of the present invention to provide a hip thrust exercise device and method of use that provide functional utility.

The present invention provides a hip thrust exercise device and method of use that allow a resistance-based hip thrusting motion of a user's hips.

According to an exemplary embodiment of the present invention, a hip thrust exercise device can include a main body, a foot mount, a grip, an extension, and a resistance element.

In an exemplary aspect of the present invention, a main body can include first and second body portions.

In another exemplary aspect of the present invention, a foot mount can be connected to the first body portion, and optionally, can be configured to abut a floor surface.

In a further exemplary aspect of the present invention, a grip can be connected to the second body portion.

In still a further exemplary aspect of the present invention, an extension can include a first extension portion connected to the main body via an extension hinge, and a second extension portion having an abutment element connected thereto.

In yet another exemplary aspect of the present invention, a resistance element can be connected between the extension and the first body portion, in which the resistance element provides a resistance force when the abutment element is moved away from the first body portion.

In an optional exemplary aspect, a hip thrust exercise device can further include a supplemental resistance element that can be engaged with the extension and the main body to provide a supplemental resistance force when the abutment element is moved away from the first body portion.

In another optional exemplary aspect, a grip can be connected to the second body portion via a grip hinge.

In yet another optional exemplary aspect, a grip can include a grip neck, the second body portion can include a hollow terminal portion, and the grip neck can be movably engaged to and within the hollow terminal portion.

In still another optional exemplary aspect, a resistance element can be adjustable to modify the resistance force.

In a further optional exemplary aspect, one of the first body portion and the second body portion can include a hollow terminal portion, and the other of the first body portion and the second body portion can be moveably engaged to and within the hollow terminal portion.

In still another optional exemplary aspect, an abutment element can include an abutment neck, the second extension portion can include a hollow terminal portion, and the abutment neck can be moveably engaged to and within the hollow terminal portion.

These and other exemplary aspects and embodiments of the present invention are further described herein.

DETAILED DESCRIPTION

It should be noted that this disclosure includes a plurality of embodiments, with a plurality of elements and aspects, and such elements and aspects need not necessarily be interpreted as being conjunctively required by one or more embodiments of the present invention. Rather, all combinations of the one or more elements and/or aspects can enable a separate embodiment of the present invention, which may be claimed with particularity in this or any one or more future filed Non-Provisional patent applications. Moreover, any particular material, structure, shape, or size disclosed herein, whether expressly or implicitly, are to be construed strictly as illustrative and enabling, and not necessarily limiting. Therefore, it is expressly set forth that any such material, structure, shape, or size, independently or in any combination thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

According to the present invention, all elements of a hip thrust exercise device can be formed from any one or more materials or combinations of materials, such as one or more of plastic, rubber, metal, or any other man-made or naturally occurring material, for example and not in limitation, insofar as the same if functionally consistent with the invention as described. Further, components of a hip thrust exercise device can be manufactured in any one or more functionally compatible manners, such as through molding, machining, forming, bending, etc., for example and not in limitation.

Figure 1:
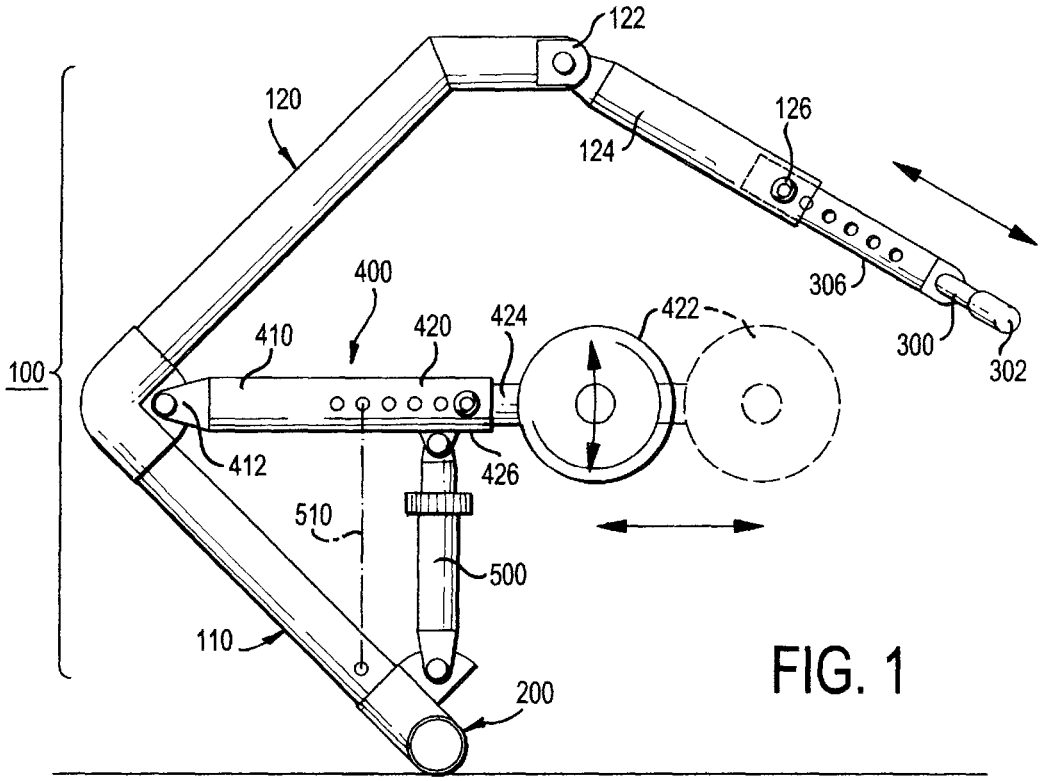
FIG. 1 illustrates a side view perspective of an exemplary hip thrust exercise device having a main body, foot mount, grip, extension, and resistance element, along with various optional aspects.

FIG. 1 illustrates an exemplary embodiment of the present invention, in which a hip thrust exercise device can include a main body 100, a foot mount 200, a grip 300, an extension 400, and a resistance element 500.

In an exemplary aspect, main body 100, which can be provided as a single unit of construction or as plural connected segments, provides the overall structural foundation to allow the hip thrust exercise of the present invention. As illustrated in FIG. 1, main body 100 can include first and second body portions 110, 120, each of which can be defined as from a point between the ends to a respective end. Further, main body 100 can be provided any functionally consistent shape, and accordingly, at least a portion of the main body can be provided with one or more of a "C" shape, a V shape, and a U shape, for example and not in limitation. Further, at least a portion of main body 100 can include any combination of one or more linear and/or curvilinear shapes, insofar as functionally consistent with the present invention.

Figure 2A:
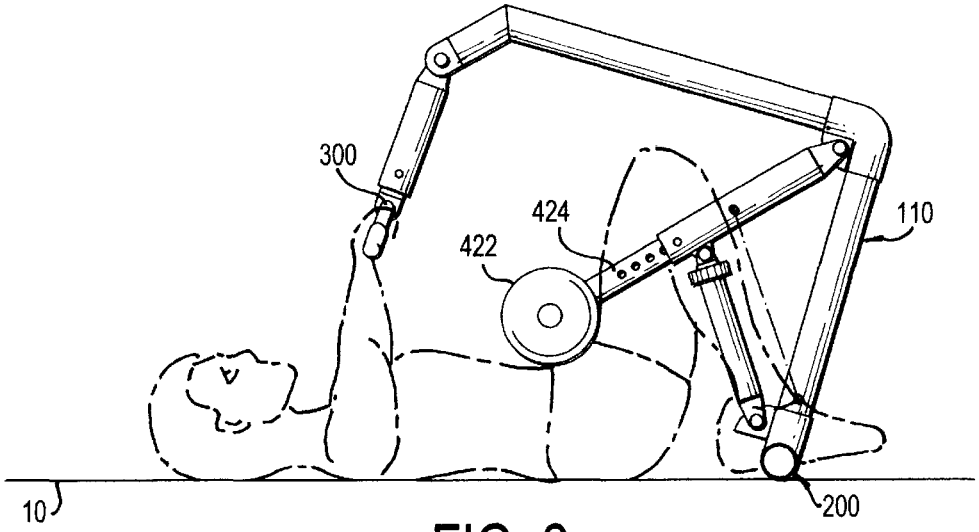
FIG. 2*a* illustrates an exemplary use of an exemplary hip thrust exercise device prior to a thrust motion.
Figure 2B:
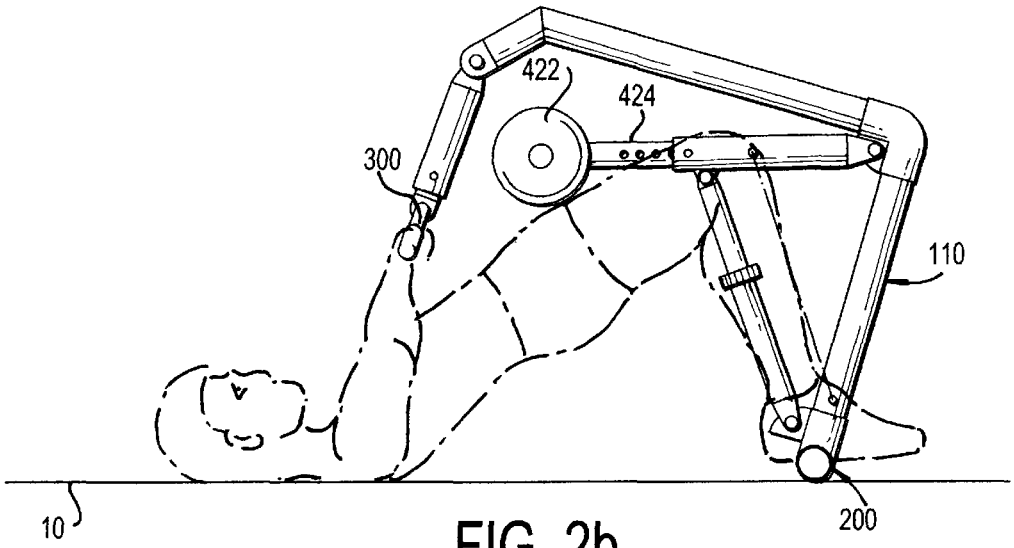
FIG. 2*b* illustrates an exemplary use of an exemplary hip thrust exercise device subsequent to a thrust motion.

As further illustrated in FIG. 1, foot mount 200 can be connected to first body portion 110, and as illustrated in FIGS. 2*a* and 2*b*, a user 1 can engage foot mount 200 with their feet to facilitate a hip thrust exercise whilst using the instant invention. It should be noted that while foot mount 200 is illustratively shown in FIG. 3 as including first and second foot rests 202, 204, a foot mount can be provided as any desired structure regardless of symmetry and structural configuration insofar as the same is functionally consistent with the present invention.

As illustrated in FIG. 1, grip 300 can be connected to second body portion 120, and as illustrated in FIGS. 2*a* and 2*b*, a user 1 can engage grip 300 with their hands to also facilitate use of the present invention. As with foot mount 200, while grip 300 is illustratively shown in FIG. 3 as including first and second handles 302, 304, a grip can be provided as any desired structure regardless of symmetry and structural configuration insofar as the same is functionally consistent with the present invention.

In another exemplary aspect, as illustrated in FIG. 1, extension 400 can include a first extension portion 410 connected to main body 100 via an extension hinge 412, and a second extension portion 420 having an abutment element 422 connected thereto.

In yet another exemplary aspect, abutment element 422 can be provided as one or more structures, which user 1 can position against their midsection. In an exemplary aspect, abutment element 422 can be provided with a blunt shape and/or a compressible material, such as a foam cushion, for example and not in limitation.

In a further exemplary aspect, as illustrated in FIG. 1, resistance element 500 be can connected to extension 400 and first body portion 110. According to the present invention, resistance element 500 can be provided as any functional one or more structures that provide a resistance force when elongated or otherwise moved apart, including for example and not in limitation, spring, hydraulic, or gas-based structures, such as a strut, as illustratively shown. In particular, one or more supplemental resistance elements 510, such as elastic bands, for example and not in limitation, may optionally be used independently or in combination therewith. Further, resistance element 510 can be provided as an adjustable resistance element insofar as desired. Notably, it is expressly contemplated that resistance element 500 can alternatively be provided, as an equivalent, via any one or more structures that provide a resistance force when compressed, with the same being disposed between extension 400 and second body portion 120. For example, and not in limitation, such an alternative structure can be a spring or a deformable bladder.

As illustrative shown in FIGS. 2*a* and 2*b*, an exemplary use of the present invention can include a user 1 laying on a floor surface 10 and engaging foot mount 200 and grip 300 as above, and thrusting or pushing abutment element 422 away from first body portion 110 with the user's midsection area. Accordingly, such motion can cause extension 400 to pivot about extension hinge 412 and away from first body portion 110, which can initiate a resistance force from elongation of resistance element 500. Notably, user 1 can also utilize the eccentric phase (or negative) of the thrust motion to increase the overall exercise function, as well as perform plural repetitions to the extent desired.

As noted above, a hip thrust exercise device can optionally include a supplemental resistance element 510, which as illustrated in FIG. 1, can be attached to first body portion 110 and extension 400. In an exemplary aspect, a user 1 can utilize supplemental resistance element 510 to increase the resistance force during utilization of the present invention.

Figure 3:
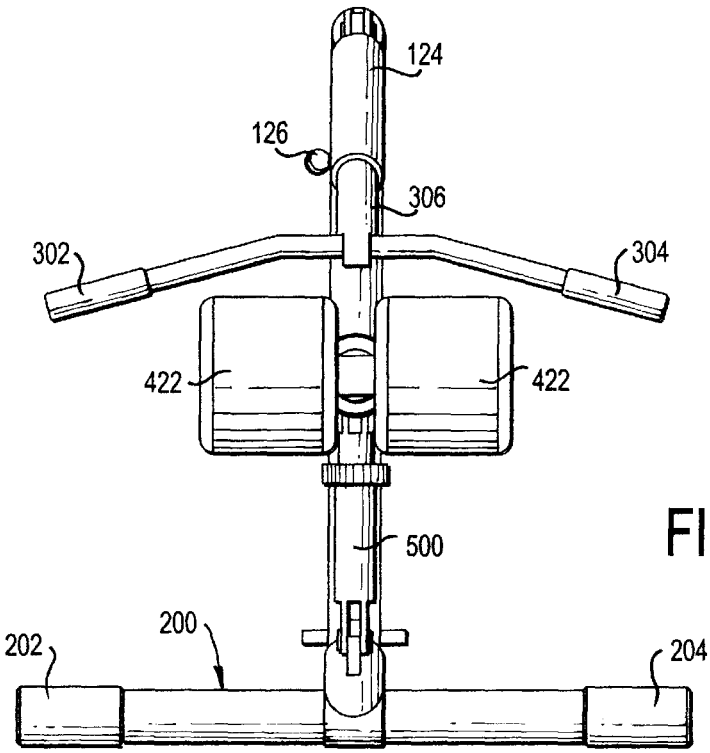
FIG. 3 illustrates a bottom view of an exemplary hip thrust exercise device.

In optional exemplary aspects, grip 300 and/or abutment element 422 can include respective necks (grip neck 306 and/or abutment neck 424), which can moveably engage within respective hollow portions 124, 426 of second body portion 120 and/or extension 400, with any such neck-hollow portion pair being complementarily shaped and/or sized. Further, such necks 306, 424 and hollow portions 124, 426 can allow respective overall lengths of grip 300 and abutment element 422 to be adjustable to accommodate size variations of different users. Further, necks 306, 424 can be fixed within respective hollow portions 124, 426 to maintain such respective desired lengths via any desired one or more fixation structures, including one or more of a thread, pin, aligned aperture, clamp, sleeve, slot, etc., for example and not in limitation. As illustrated in FIGS. 1 and 3, respective necks 306, 424 can be provided with a series of apertures A, which can align with one or more apertures A in extension 400 to accommodate a pin 126.

In another optional exemplary aspect, second body portion 120 can optionally include a grip hinge 122, to which grip 300 can be connected, directly or indirectly, to render the grip's angle to be pivotally adjustable, and subsequently fixed within a range of motion or in one or more particular angles, to also accommodate size variations of different users and/or modify muscular activity during use of the present invention. Fixation can be effectuated with in any desired one or more structures, such as, for example and not in limitation, one or more of a screw, pin, aperture, etc., in so far as the same is functionally compatible with the present invention.

Figure 4:
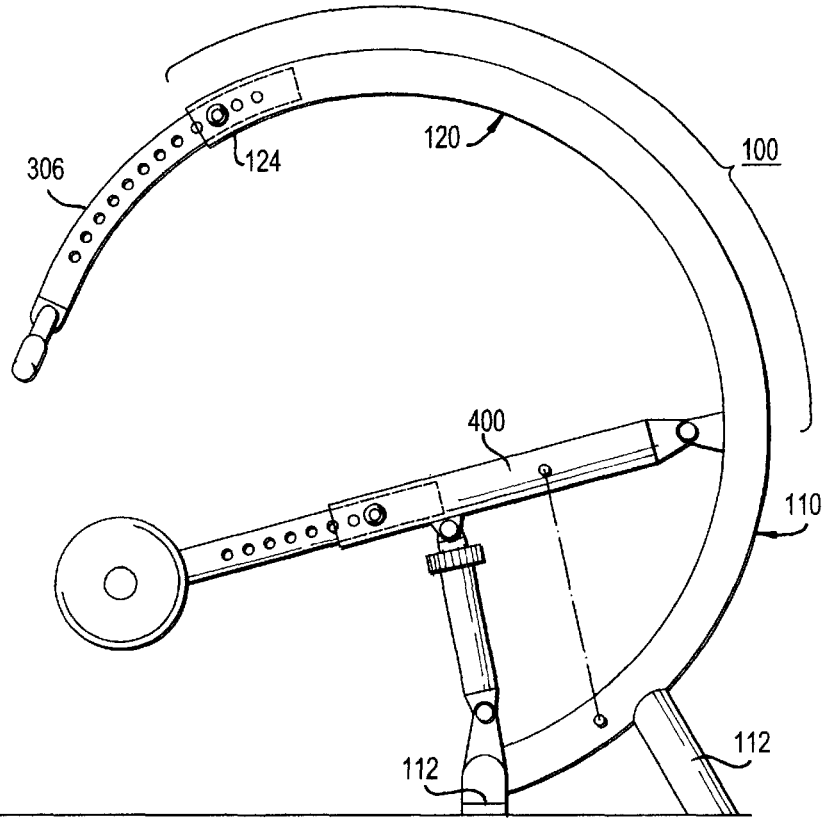
FIG. 4 illustrates a side view of an exemplary hip thrust exercise device having a C shaped main body.

FIG. 4 illustrates another exemplary embodiment of the present invention, in which main body 100 can be provided with a "C" shape (as noted supra) and/or include one or more feet 112 to allow such a device to be self-standing on floor surface 10.

Figure 5A:
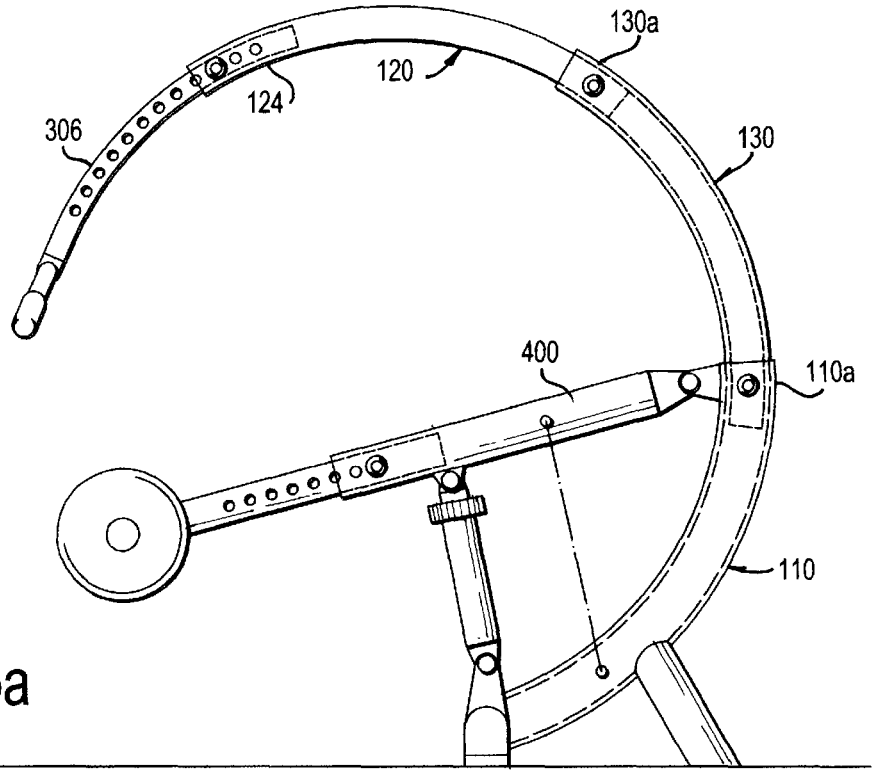
FIG. 5*a* illustrates a side view perspective of an exemplary hip thrust exercise device having a C shaped telescoping main body in a telescoped configuration.
Figure 5B:
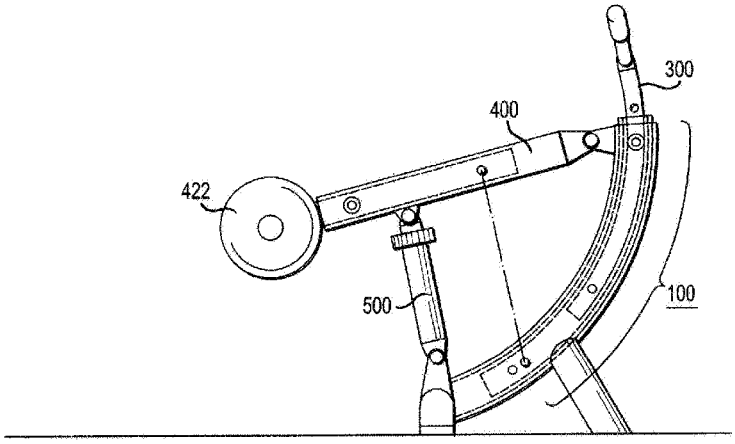
FIG. 5*b* illustrates a side view perspective of an exemplary hip thrust exercise device having a C shaped telescoping main body in a storage configuration.

FIGS. 5*a* and 5*b* illustrate yet another exemplary embodiment, in which main body 100 can include plural telescoping portions. FIG. 5*a* illustrates such an embodiment in a telescoped configuration. For example and not in limitation, as illustrated, in addition to first and second body portions 110, 120, main body 100 can further include one or more additional portions, which for convenience, are illustrated in a simplified example as a single third body portion 130. In an exemplary aspect, for at least one of each pair of adjacent body portions, one of body portions can include a hollow portion within which the other body portion can moveably engage, and fix in place via any desired one or more structures desired, such as an aperture-pin pair as illustrated.

FIG. 5*b* illustrates such a telescoping embodiment in a storage configuration, in which at least one body portion can be moved within another to reduce the overall size of the hip thrust exercise device.

Figure 6:
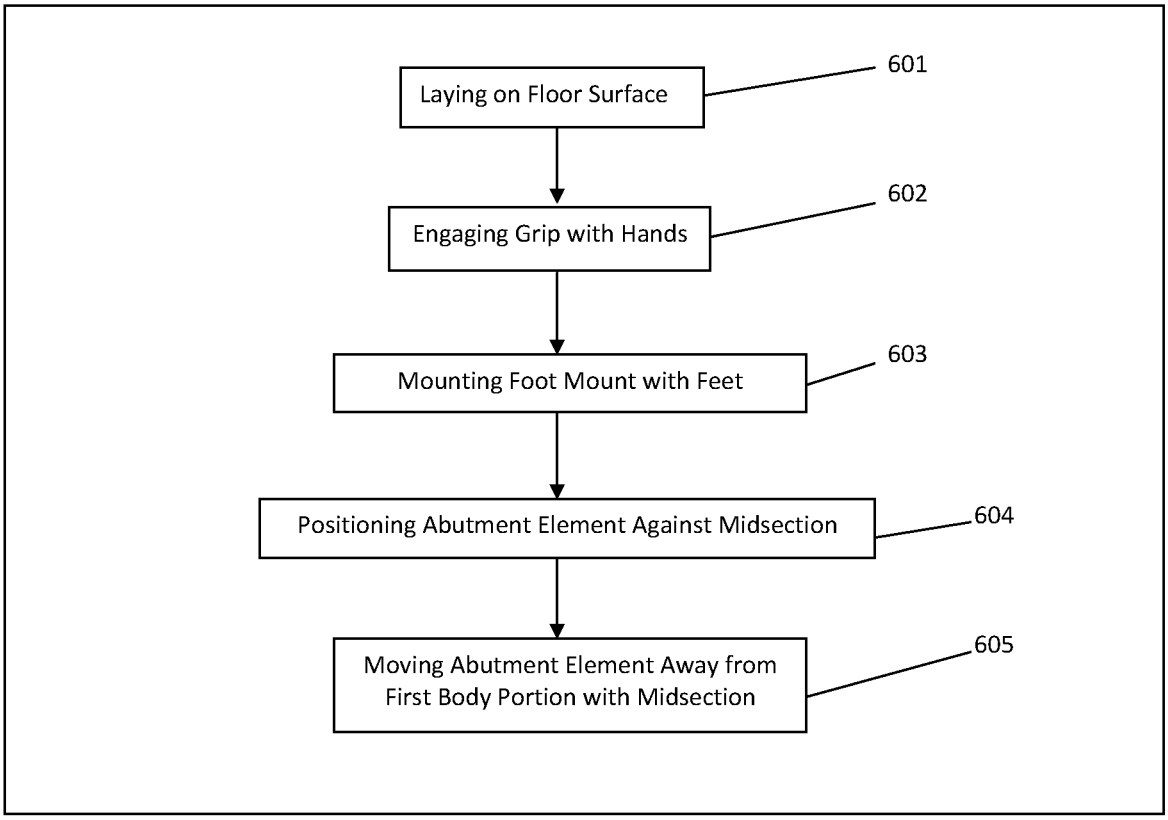
FIG. 6 illustrates exemplary method steps according to an exemplary method of using a hip thrust exercise device.

FIG. 6 illustrates exemplary method steps according to an exemplary method of using a hip thrust exercise device. As illustrated, such method steps can include laying on a floor surface (step 601); engaging grip 300 with a user's hands (step 602); mounting foot mount 200 with the user's feet (step 603); positioning abutment element 422 against the user's midsection (step 604); and moving the abutment element away from first body portion 110 with the user's mid-section.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention. For example, while the present invention is illustratively shown having various necks, apertures, and hollow portions for adjustment-based moveable engagement, their respective locations can be reversed resulting in identical functional utility.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A hip thrust exercise device, comprising:

a main body having first and second body portions, the first body portion having a proximate first body portion end and a distal first body portion end;

a foot mount connected at the distal first body portion end;

a grip connected to the second body portion;

an extension having a first extension end connected at the proximate first body portion end via an extension hinge and a second extension end having an abutment element connected thereto; and a resistance element connected between and to said extension by a first resistance element hinge and the distal first body portion end by a second resistance element hinge;

wherein said resistance element provides a resistance force when the abutment element is moved away from the distal first body portion end, and said resistance element is configured to simultaneously pivot about the first and second resistance element hinges.

2. The device of claim 1, wherein at least a portion of said main body is provided with one of a C shape, a V shape, and a U shape.

3. The device of claim 1, further comprising a supplemental resistance element engaged with said extension and said main body, wherein said supplemental resistance element provides a supplemental resistance force when said abutment element is moved away from the distal first body portion end.

4. The device of claim 1, wherein the second body portion includes a grip hinge.

5. The device of claim 4, wherein said grip includes a grip neck, the second body portion includes a hollow terminal portion, and the grip neck is engaged to and within the hollow terminal portion.

6. The device of claim 1, wherein said grip includes a grip neck, the second body portion includes a hollow terminal portion, and the grip neck is engaged to and within the hollow terminal portion.

7. The device of claim 1, wherein one of the first body portion and the second body portion includes a hollow terminal portion, and the other of the first body portion and the second body portion is engaged to and within the hollow terminal portion.

8. The device of claim 1, wherein the abutment element includes an abutment neck, the second extension end includes a hollow terminal portion, and the abutment neck is engaged to and within the hollow terminal portion.

9. A method of using a hip thrust exercise device by a user, the device including a main body having first and second body portions, the first body portion having a proximate first body portion end and a distal first body portion end, a foot mount connected at the distal first body portion end, a grip connected to the second body portion, an extension having a first extension end connected at the proximate first body portion end via an extension hinge and a second extension end having an abutment element connected thereto, and a resistance element connected between and to said extension by a first resistance element hinge and distal first body portion end via a second resistance element hinge, said method comprising the steps of:

laying on a floor surface;

engaging the grip with the user's hands;

mounting the foot mount with the user's feet;

positioning the abutment element against a mid-section of the user; and moving the abutment element away from the first body portion with the user's mid-section;

wherein said resistance element provides a resistance force when the abutment element is moved away from the distal first body portion end, and said resistance element is configured to simultaneously pivot about the first and second resistance element hinges.

10. A hip thrust exercise device, comprising:

a main body having first and second body portions, the first body portion having a proximate first body portion end and a distal first body portion end;

a foot mount connected at the distal first body portion end;

a grip connected to the second body portion;

an extension having a first extension end connected at the proximate first body portion end via an extension hinge and a second extension portion having an abutment element connected thereto; and a resistance element connected between and to said extension and the distal first body portion end;

wherein said resistance element provides a resistance force when the abutment element is moved away from the distal first body portion end.

11. The device of claim 10, wherein at least a portion of said main body is provided with one of a C shape, a V shape, and a U shape.

12. The device of claim 10, further comprising a supplemental resistance element engaged with said extension and said main body, wherein said supplemental resistance element provides a supplemental resistance force when said abutment element is moved away from the distal first body portion end.

13. The device of claim 10, wherein the second body portion includes a grip hinge.

14. The device of claim 13, wherein said grip includes a grip neck, the second body portion includes a hollow terminal portion, and the grip neck is engaged to and within the hollow terminal portion.

15. The device of claim 14, wherein said grip includes a grip neck, the second body portion includes a hollow terminal portion, and the grip neck is engaged to and within the hollow terminal portion.

16. The device of claim 10 wherein one of the first body portion and the second body portion includes a hollow terminal portion, and the other of the first body portion and the second body portion is engaged to and within the hollow terminal portion.

17. The device of claim 10, wherein the abutment element includes an abutment neck, the second extension end includes a hollow terminal portion, and the abutment neck is engaged to and within the hollow terminal portion.

* * * * *